US008911925B2

(12) United States Patent
Oki et al.

(10) Patent No.: US 8,911,925 B2
(45) Date of Patent: Dec. 16, 2014

(54) LIQUID DEVELOPER, DEVELOPER CARTRIDGE, PROCESS CARTRIDGE, IMAGE FORMING APPARATUS, AND IMAGE FORMING METHOD

(75) Inventors: Masahiro Oki, Kanagawa (JP); Yoshihiro Inaba, Kanagawa (JP); Akira Imai, Kanagawa (JP); Daisuke Yoshino, Kanagawa (JP); Takako Kobayashi, Kanagawa (JP); Koji Horiba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 87 days.

(21) Appl. No.: 13/590,671

(22) Filed: Aug. 21, 2012

(65) Prior Publication Data

US 2013/0224650 A1 Aug. 29, 2013

(30) Foreign Application Priority Data

Feb. 24, 2012 (JP) ..... 2012-038413

(51) Int. Cl.
*G03G 9/00* (2006.01)
*G03G 15/10* (2006.01)

(52) U.S. Cl.
USPC ..... 430/114; 430/108.2; 430/108.21; 430/108.22; 430/112; 430/117.1

(58) Field of Classification Search
CPC ..... G03G 9/09; G03G 9/0906; G03G 9/0902; G03G 9/0904; G03G 15/10
USPC ..... 430/118.6, 108.2, 108.21, 108.22, 112, 430/114, 123.5, 124.1; 399/111, 237
See application file for complete search history.

(56) References Cited

U.S. PATENT DOCUMENTS

| | | | | |
|---|---|---|---|---|
| 4,621,039 | A * | 11/1986 | Ciccarelli et al. | 430/108.22 |
| 2002/0086916 | A1 | 7/2002 | Morrison et al. | |
| 2002/0128349 | A1 | 9/2002 | Qian et al. | |
| 2005/0009952 | A1 | 1/2005 | Qian et al. | |
| 2010/0248127 | A1 * | 9/2010 | Inaba et al. | 430/112 |

FOREIGN PATENT DOCUMENTS

| | | |
|---|---|---|
| JP | A-7-134447 | 5/1995 |
| JP | A-10-260557 | 9/1998 |
| JP | A-2002-212480 | 7/2002 |
| JP | A-2008-122787 | 5/2008 |

* cited by examiner

*Primary Examiner* — Thorl Chea
(74) *Attorney, Agent, or Firm* — Oliff PLC

(57) ABSTRACT

A liquid developer contains a carrier liquid, and toner particles containing a binder resin and a pigment surface-treated with a polyallylamine compound as a colorant.

10 Claims, 1 Drawing Sheet

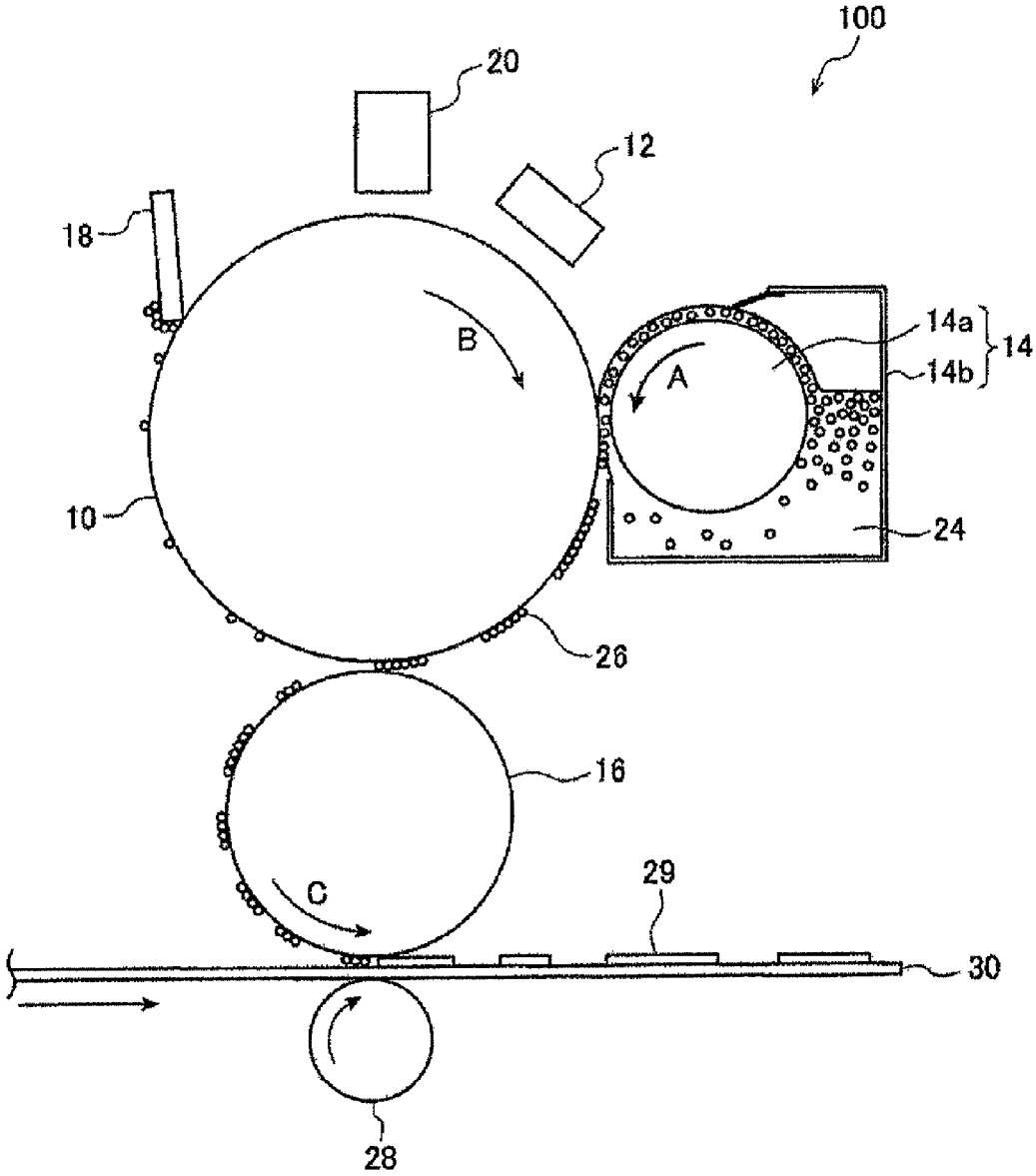
100
20
12
18
B
A
14a
14
14b
10
24
26
16
C
29
30
28

LIQUID DEVELOPER, DEVELOPER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-038413 filed Feb. 24, 2012.

BACKGROUND

1. Technical Field

The present invention relates to a liquid developer, a developer cartridge, a process cartridge, an image forming apparatus, and an image forming method.

2. Related Art

The method of visualizing image information through an electrostatic image, such as electrophotography, is currently used in various fields. In an electrophotographic method, a latent image (electrostatic latent image) is formed on an image holding member through a charging step and an exposure step (latent image forming step); the electrostatic latent image is developed by using a developer for electrostatic image development (hereinafter, may be simply referred to as "developer") containing a toner for electrostatic image development (hereinafter, may be simply referred to as "toner") (developing step); and the image is visualized through a transfer step and a fixing step. Developers that are used for a dry development system are classified into a two-component developer composed of a toner and a carrier, and a single-component developer using a magnetic toner or a non-magnetic toner alone.

On the other hand, liquid developers that are used in a wet development system are developers having toner particles dispersed in an insulating carrier liquid, and a type of developer in which toner particles containing a thermoplastic resin are dispersed in a volatile carrier liquid; a type of developer in which toner particles containing a thermoplastic resin are dispersed in a non-volatile carrier liquid; and the like are known.

SUMMARY

According to an aspect of the present invention, there is provided a liquid developer containing a carrier liquid, and toner particles containing a binder resin and a pigment surface-treated with a polyallylamine compound as a colorant.

BRIEF DESCRIPTION OF THE DRAWINGS

Exemplary embodiments of the present invention will be described in detail based on the following FIGURE, wherein:

FIG. 1 is a schematic configuration diagram illustrating an example of the image forming apparatus according to the exemplary embodiment of the present invention.

DETAILED DESCRIPTION

An exemplary embodiment of the present invention will be described below. This exemplary embodiment is just an example for carrying out the present invention, and the present invention is not intended to be limited to this exemplary embodiment.

Liquid Developer

The liquid developer according to the exemplary embodiment contains a carrier liquid, and toner particles containing a binder resin and a pigment that is surface-treated with a polyallylamine compound as a colorant. As developers for positive charging that are used in a dry development system, quaternary ammonium salts, isocyanate compounds and the like are generally added. However, even if these materials are applied to liquid developers, the charging effect may be low, and sufficient positive chargeability may not be obtained. Furthermore, in regard to the charge control of developers, since there is a variation in chargeability due to the colorant, there have been occasions in which there are differences in chargeability between colors when a four-color system is adopted.

In the exemplary embodiment, a liquid developer having excellent positive chargeability may be obtained by using a pigment that is surface-treated with a polyallylamine compound as a colorant.

Regarding the reason why excellent positive chargeability is obtained when the liquid developer according to the exemplary embodiment is used, it can be speculated to be as follows. In this charge-controlling agent, it may be speculated that since a highly cationic polyallylamine compound is strongly adhering to the surface of a pigment, it is difficult for the polyallylamine compound to detach from the surface of the pigment at the time of preparing a developer liquid, and positive chargeability is maintained. Furthermore, it is speculated that the same effects may be obtained even after recycling of the developer. Particularly, at the time of the surface treatment of the pigment, since a resin and a polyallylamine compound are added to the pigment dispersion liquid, and the mixture is treated by a flushing treatment of performing mixing and stirring, the polyallylamine compound more strongly adheres to the surface of the pigment. Therefore, it is contemplated that it is more difficult for the polyallylamine compound to detach from the surface of the pigment when the mixture is prepared as a developer liquid, and positive chargeability is maintained. It is thought that when the pigment and the polyallylamine compound are simply mixed at the time of the surface treatment of the pigment, the polyallylamine compound easily detaches from the surface of the pigment at the time of preparing a developer liquid, and it is difficult to maintain positive chargeability. Furthermore, since the polyallylamine compound is nearly colorless, the polyallylamine compound does not easily impose an adverse influence on colors such as yellow, magenta and cyan. Furthermore, it is believed that differences in chargeability between the colors of yellow, magenta, cyan and black do not easily occur.

Hereinafter, the constituent components of the liquid developer according to the exemplary embodiment of the present invention will be described in detail.

Colorant

According to the exemplary embodiment, the colorant is a pigment which is surface-treated with a polyallylamine compound so that the polyallylamine compound strongly adheres to the surface.

The polyallylamine compound is one kind of polyamine, and as compared with quaternary ammonium salts or isocyanate compounds for positive charging that are generally used in dry development systems, polyallylamine compounds are highly cationic and easily positively charged.

The weight average molecular weight of the polyallylamine compound is preferably in the range of 15,000 to 30,000, and more preferably in the range of 20,000 to 30,000. If the weight average molecular weight of the polyallylamine compound is less than 15,000, positive chargeability is weak, and the intended developing properties may not be obtained. If the weight average molecular weight is greater than 30,000, sufficient positive chargeability may not be obtained depending on the type of the binder resin contained in the toner particles. Furthermore, if the weight average molecular weight of the polyallylamine compound is greater than 30,000, transfer properties of the toner may deteriorate. Therefore, when the weight average molecular weight of the polyallylamine compound is adjusted to the range described above, a liquid developer having excellent positive chargeability may be obtained more effectively.

According to the exemplary embodiment, the colorant is preferably obtained by surface treating the pigment by a flushing treatment of adding a resin and a polyallylamine compound to a dispersion liquid of a pigment, and performing mixing and stirring. The flushing treatment generally refers to an operation involving adding a resin, additives and the like to a dispersion liquid such as an aqueous dispersion liquid of a hydrophobic pigment, heating as necessary, and mixing and stirring the mixture with a kneading machine such as a kneader, in which during this mixing and stirring process, the pigment present in the solvent such as water is transferred into the resin, and at the same time, water and the like are separated. The flushing treatment may be carried out by using, for example, a common two-roll mill, a three-roll mill, a kneader, or a twin-screw kneading extruder.

At the time of kneading, for example, the flushing treatment is carried out by using a wet cake pigment, a binder resin, and a polyallylamine compound.

When such a flushing treatment is carried out, since the polyallylamine compound adheres more strongly to the surface of the pigment, the polyallylamine compound does not easily detach from the surface of the pigment at the time of preparing the developer liquid. In the flushing treatment, heating may be carried out at a temperature from about 50° C. to 120° C. The dispersion solvent for the pigment used in the flushing treatment is usually water or an organic solvent, but water is preferred.

In regard to the quaternary ammonium salts and isocyanate compounds for positive charging that are generally used in a dry developing system, it is contemplated that even if the pigment is surface-treated by a flushing treatment, the quaternary ammonium salts and isocyanate compounds have poor positive chargeability, so that the same effect as that provided by polyallylamine compounds may not be readily obtained in a liquid developer that is used not in friction charging but in a wet developing system.

The resin used in the flushing treatment may be the same as the binder resin included in the toner particles, or may be a different resin; however, it is preferable that the resin be the same as the binder resin included in the toner particles. As the resin used in the flushing treatment, the same resins as the binder resin included in the toner particles that will be described below may be used.

The acid value of the resin used in the flushing treatment is preferably in the range of 1 mg KOH/g to 30 mg KOH/g, and more preferably in the range of 5 mg KOH/g to 20 mg KOH/g. When the acid value is in this range, the effect of the polyallylamine compound is more effectively exhibited, and excellent positive chargeability is obtained. If the acid value of the resin is less than 1 mg KOH/g, the adsorption of the resin to the pigment is insufficient, and kneading may become difficult. Furthermore, if the acid value is greater than 30 mg KOH/g, the effect of the polyallylamine compound is canceled, and desired chargeability may not be obtained.

According to the exemplary embodiment, as an index indicating that a polyallylamine compound is strongly adhering to the surface of a pigment, conductivity of the liquid developer may be used. When the polyallylamine compound is detached from the surface of the pigment in a liquid developer, the conductivity of the liquid developer tends to increase. Thus, according to the exemplary embodiment, the conductivity of the liquid developer is preferably $5.0\times10^{-10}$ S/m or less, and more preferably $1.0\times10^{-11}$ S/m or less. If the conductivity of the liquid developer exceeds $5.0\times10^{-10}$ S/m, it is observed that the amount of the polyallylamine compound detached from the surface of the pigment is large, and thus it can be said that the polyallylamine compound is not strongly adhering to the surface of the pigment.

The amount of the polyallylamine compound with respect to the pigment is, for example, preferably in the range of 0.5 part by weight to 3 parts by weight, and more preferably in the range of 1 part by weight to 2 parts by weight, relative to 100 parts by weight of the pigment. If the amount of the polyallylamine compound based on the pigment is less than 0.5 part by weight relative to 100 parts by weight of the pigment, chargeability may deteriorate. If the amount is greater than 3 parts by weight, chargeability is so high that transfer properties may deteriorate.

The colorant is not particularly limited, and known pigments are used, and if necessary, the colorant may also include known dyes. Specifically, various pigments of yellow, magenta, cyan and black listed below are used.

Examples of the yellow pigment that may be used include compounds represented by condensed azo compounds, isoindolinone compounds, anthraquinone compounds, azo metal complex compounds, methine compounds, and allylamide compounds.

Examples of the magenta pigment that may be used include condensed azo compounds, diketopyrrolopyrrole compounds, anthraquinone, quinacridone compounds, basic dye lake compounds, naphthol compounds, benzimidazolone compounds, thioindigo compounds, and perylene compounds.

Examples of the cyan pigment that may be used include copper phthalocyanine compound and derivatives thereof, anthraquinone compounds, and basic dye lake compounds.

Examples of the black pigment that may be used include carbon black, aniline black, acetylene black, and iron black.

As the pigment used in the surface treatment such as a flushing treatment, a pigment that is not surface-treated may be used, or a pigment that is surface-treated with a known surface treating agent such as rosin may also be used.

When the pigment is surface-treated with a polyallylamine compound, for even a pigment that is not easily positively charged, such as carbon black, a liquid developer having excellent positive chargeability may be obtained.

Toner Particles

The toner particles included in the liquid developer according to the exemplary embodiment contain a binder resin and the colorant described above, and if necessary, may also contain other components such as a release agent.

Binder Resin

The binder resin is not particularly limited, but examples thereof include polyesters, polystyrene, styrene-acrylic resin such as a styrene-alkyl acrylate copolymer and a styrene-alkyl methacrylate copolymer, a styrene-acrylonitrile copolymer, a styrene-butadiene copolymer, a styrene-maleic anhydride copolymer, polyethylene, polypropylene. Other examples thereof include polyurethane, epoxy resin, silicone resin, polyamide, modified rosin, and paraffin wax. The binder resin may be used individually, or a mixture of two or more kinds of resins may be used. Examples of the form of using a mixture of two or more kinds of resins include a mixture of a thermoplastic resin and a thermoplastic elastomer, and more specific examples include a mixture of a styrene thermoplastic resin and a styrene thermoplastic elastomer, such as a mixture of a styrene-acrylic resin and a styrene thermoplastic elastomer.

The styrene thermoplastic resin is a thermoplastic resin having a repeating unit derived from a monomer having a styrene skeleton (hereinafter, may be referred to as a "styrene monomer"). Here, the "repeating unit derived from a styrene monomer" means a repeating unit prepared as a result of a reaction of a styrene monomer, among the repeating units constituting the polymer. The same applies to the repeating units derived from other monomers.

Examples of the styrene monomer include styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-dodecylstyrene, p-methoxystyrene, p-phenylstyrene, p-chlorostyrene, and 3,4-dichlorostyrene.

Furthermore, the styrene thermoplastic resin may be a copolymer of a styrene monomer and other monomer. Examples of the other monomer include a monomer having an acrylic acid ester structure (hereinafter, may be referred to as "acrylic acid ester monomer"), and another monomer having vinyl group (hereinafter, may be referred to as "vinyl monomer").

Specific examples of the acrylic acid ester monomer include alkyl esters of (meth)acrylic acid such as methyl (meth)acrylate, ethyl (meth)acrylate, propyl (meth)acrylate, n-butyl (meth)acrylate, isobutyl (meth)acrylate, n-octyl (meth)acrylate, dodecyl (meth)acrylate, 2-ethylhexyl acrylate, and stearyl (meth)acrylate; 2-chloroethyl acrylate, phenyl (meth)acrylate, methyl α-chloroacrylate, (meth)acrylate, 2-hydroxypropyl 2-hydroxyethyl (meth)acrylate, 2-hydroxybutyl (meth)acrylate, glycidyl dimethylaminoethyl methacrylate, (meth)acrylate, diethylaminoethyl methacrylate, bisglycidyl methacrylate, polyethylene glycol dimethacrylate, and methacryloxyethyl phosphate. These may be used individually, or two or more kinds of monomers may be used in combination. Meanwhile, "(meth)acryl" means any one or both of acryl and methacryl.

Examples of the other vinyl monomer include olefin monomers such as ethylene, propylene, butylene, butadiene, and isoprene; vinyl ester monomers such as vinyl formate, vinyl acetate, vinyl propionate, and vinyl benzoate; acrylic acid and α- or β-alkyl derivatives thereof, such as acrylic acid, methacrylic acid, α-ethylacrylic acid, and crotonic acid; unsaturated dicarboxylic acid and monoester derivatives or diester derivatives thereof, such as fumaric acid, maleic acid, citraconic acid, and itaconic acid; succinic acid mono(meth)acryloyloxyethyl ester, (meth)acrylonitrile, and acrylamide.

The weight average molecular weight (Mw) of the thermoplastic resin may be, for example, in the range of 150,000 and 500,000. Furthermore, the molecular weight distribution (Mw/Mn) of the thermoplastic resin may be, for example, in the range of 2 to 20. Meanwhile, the thermoplastic resin may have plural peaks or shoulders in the molecular weight distribution measured by gel permeation chromatography (GPC).

The weight average molecular weight (Mw) described above is measured by gel permeation chromatography (GPC). The measurement of molecular weight by GPC is carried out by using a GPC.HLC-8120 manufactured by Tosoh Corp. as an analysis instrument, a TSKgel SuperHM-M (15 cm) column manufactured by Tosoh Corp., and tetrahydrofuran (THF) as a solvent. The weight average molecular weight is calculated from these measurement results, by a molecular weight calibration curve created by using monodisperse polystyrene standard samples. The measurement of the weight average molecular weight is carried out as follows. Furthermore, the measurement of the number average molecular weight (Mn) is also carried out in the same manner as in the case of the weight average molecular weight (Mw), and from those values, the molecular weight distribution (Mw/Mn) is calculated.

The content of the styrene thermoplastic resin in the toner particles is preferably in the range of 50% by weight to 95% by weight, and more preferably in the range of 60% by weight to 90% by weight, relative to the total amount of the binder resin, from the viewpoint of pulverizability or the like.

The styrene thermoplastic elastomer resin is a thermoplastic elastomer resin having at least a repeating unit derived from a styrene monomer. Examples of the thermoplastic elastomer resin include polymers which have rubber-like properties at normal temperature (for example, 25° C.) and are softened similarly to thermoplastics at a high temperature.

Specific examples of the styrene thermoplastic elastomer resin include block copolymers of the styrene monomers described above and the olefin monomers described above. More specific examples thereof include polystyrene-polybutadiene-polystyrene, polystyrene-polybutadiene/butylene-polystyrene, polystyrene-polyethylene/butylene-polystyrene, polystyrene-polyisoprene-polystyrene, polystyrene-hydrogenated polybutadiene-polystyrene, polystyrene-hydrogenated polyisoprene-polystyrene, and polystyrene-hydrogenated poly(isoprene/butadiene)-polystyrene.

Meanwhile, in regard to the specific examples described above, for example, the expression "polystyrene-polybutadiene/butylene-polystyrene" means a block copolymer in which a block of polystyrene, a block of polybutadiene, and a block of polystyrene are bonded in this sequence, in which structure of the block of butadiene is partially hydrogenated. That is, the expression "polybutadiene/butylene" means a block in which a butadiene section and a butylene section having hydrogenated butadiene are co-present. Furthermore, in the specific examples described above, for example, the expression "hydrogenated polybutadiene" means a polymer obtained by hydrogenating the double bonds of polybutadiene.

Furthermore, in regard to these block copolymers, a block copolymer into which a polar group has been put into a soft segment that is sandwiched between polystyrenes, may also be used. Examples of the polar group include a hydroxyl group, a carboxyl group, an amino group, and an acyl group.

The weight average molecular weight Mw of the styrene thermoplastic elastomer resin is, for example, in the range of 30,000 to 300,000.

Examples of commercially available products of the styrene thermoplastic elastomer resin include TUFTEK M1911, TUFTEK M1943, TUFTEK MP10, ASAPRENE T439, and TUFPRENE A manufactured by Asahi Kasei Corp.; and DYNARON 8630P manufactured by Kuraray Co., Ltd.

When the binder resin is a mixture of a thermoplastic resin and a thermoplastic elastomer resin, the content of the thermoplastic resin is, for example, in the range of 50% by weight to 90% by weight relative to the total amount of the toner particles, and may be in the range of 50% by weight to 70% by weight. Furthermore, the content of the thermoplastic elastomer resin is, for example, in the range of 5% by weight to 50% by weight relative to the total amount of the toner particles, and may be in the range of 10% by weight to 40% by weight.

The toner particles related to the exemplary embodiment may contain other additives such as a release agent, a charge-controlling agent, a silica powder and a metal oxide, as necessary. These additives may be internally added by kneading into the binder resin, or may be externally added by obtaining toner particles as particles and then subjecting the toner particles to a mixing treatment.

The release agent is not particularly limited, and examples thereof include vegetable waxes such as carnauba wax, wood wax and rice bran wax; animal waxes such as beeswax, insect waxes, whale wax, and wool wax; mineral waxes such as montan wax and ozokerite; synthetic fatty acid solid ester waxes such as Fischer-Tropsch wax (FT wax) having an ester in a side chain, special fatty acid esters, and polyhydric alcohol esters; and synthetic waxes such as paraffin wax, polyethylene wax, polypropylene wax, polytetrafluoroethylene wax, polyamide wax, and silicone compounds. The release agents may be individually used, or two or more kinds may be used in combination.

The charge-controlling agent is not particularly limited, and known charge-controlling agents in the related art are used. Examples thereof include positively chargeable charge-controlling agents such as nigrosin dyes, fatty acid-modified nigrosin dyes, carboxyl group-containing fatty acid-modified nigrosin dyes, quaternary ammonium salts, amine compounds, amide compounds, imide compounds, and organometallic compounds; and negatively chargeable charge-controlling agents such as metal complexes of oxycarboxylic acids, metal complexes of azo compounds, metal complex salt dyes, and salicylic acid derivatives. The charge-controlling agents may be used individually, or two or more kinds may be used in combination.

The metal oxide is not particularly limited, and examples thereof include titanium oxide, aluminum oxide, magnesium oxide, zinc oxide, strontium titanate, barium titanate, magnesium titanate, and calcium titanate. The metal oxides may be used individually, or two or more kinds may be used in combination.

Method for Preparing Toner Particles

The method for preparing toner particles used in this exemplary embodiment is not particularly limited, and for example, toner particles may be obtained by pulverizing a toner prepared by a method for preparing, for example a pulverized toner, an in-liquid emulsified and dried toner, or a polymerized toner, in a carrier liquid.

For example, a pulverized toner is obtained by putting a binder resin, a pigment surface-treated with a polyallylamine compound as a colorant, and if necessary, other additives into a mixing apparatus such as a Henschel Mixer, mixing the components, melt kneading this mixture with a twin-screw extruder, a Banbury mixer, a roll mill, a kneader or the like, subsequently cooling the kneading product with a drum flaker or the like, crude pulverizing the resultant with a pulverizer such as a hammer mill, further pulverizing the crude pulverization product with a pulverizer such as a jet mill, and then classifying the pulverization product by using an air classifier or the like.

Furthermore, an in-liquid emulsified and dried toner is obtained by dissolving a binder resin, a pigment surface-treated with a polyallylamine compound as a colorant, and if necessary, other additives in a solvent such as ethyl acetate, emulsifying and suspending the solution in water containing a dispersion stabilizer such as calcium carbonate, removing the solvent, subsequently removing the dispersion stabilizer, and filtering and drying the particles thus obtained.

Furthermore, a polymerized toner is obtained by adding and granulating a composition containing a polymerizable monomer forming a binder resin, a pigment surface-treated with a polyallylamine compound as a colorant, a polymerization initiator (for example, benzoyl peroxide, lauroyl peroxide, isopropyl peroxycarbonate, cumene hydroperoxide, 2,4-dichlorylbenzoyl peroxide, and methyl ethyl ketone peroxide) and other additives in an aqueous phase under stirring, performing a polymerization reaction, and then filtering and drying particles.

Meanwhile, the mixing proportions of the various materials (a binder resin, a colorant, other additives, and the like) employed when a toner is obtained, may be set in consideration of the requested characteristics, low temperature fixability, color and the like. The toner thus obtained is pulverized in a carrier oil by using a known pulverizing apparatus such as a ball mill, a bead mill, or a high pressure wet micronizing apparatus, and thereby toner particles for liquid developer of the exemplary embodiment is obtained.

Characteristics of Toner Particles

The volume average particle size D50v of the toner particles is preferably from 0.5 μm to 5.0 μm. When the volume average particle size is in the range described above, high adhesion force is obtained, and an enhancement of developability may be promoted. Furthermore, an increase in the resolution of images may also be promoted. The volume average particle size D50v of the toner particles is more preferably in the range of 0.8 μm to 4.0 μm, and even more preferably in the range of 1.0 μm to 3.0 μm.

The volume average particle size D50v, number average particle size distribution index (GSDp), and volume average particle size distribution index (GSDv) and the like of the toner particles are measured by using a laser diffraction/scattering type particle size distribution measuring apparatus, for example, LA920 (manufactured by Horiba, Ltd.). Accumulated distributions of volume and number are respectively prepared from the side of smaller particle size against particle size ranges (channels) partitioned based on the particle size distribution, and the particle sizes accumulated at 16% are defined as volume D16v and number D16p; the particle sizes accumulated at 50% as volume D50v and number D50p; and the particle sizes accumulated at 84% as volume D84v and number D84p. Using these data, the volume average particle size distribution index (GSDv) is calculated as $(D84v/D16v)^{1/2}$ and the number average particle size distribution index (GSDp) is calculated as $(D84p/D16p)^{1/2}$.

Carrier Liquid

The carrier liquid is an insulating liquid for dispersing the toner particles, and there are no particular limitations, but for example, aliphatic hydrocarbon solvents containing aliphatic hydrocarbons such as paraffin oils as main components (commercially available products include MORESCO WHITE MT-30P, MORESCO WHITE P40 and MORESCO WHITE P70 manufactured by Matsumura Sekiyu Co., Ltd.; ISOPAR L and ISOPAR M manufactured by Exxon Mobil Corp.); and hydrocarbon solvents such as naphthene oils (commercially available products include EXOL D80, EXOL D110, and EXOL D130 manufactured by Exxon Mobil Corp.; NAPHTESOL L, NAPHTESOL M, NAPHTESOL H, New NAPHTESOL 160, New NAPHTESOL 200, New NAPHTESOL 220, and New NAPHTESOL MS-20P manufactured by Nippon Petrochemicals Co., Ltd.) are exemplified. Aromatic compounds such as toluene may also be incorporated into them. Among these, from the viewpoint of developability, aliphatic hydrocarbon solvents containing aliphatic hydrocarbons as main components are preferably used.

The carrier liquid contained in the liquid developer according to the exemplary embodiment may be composed of one kind, or a mixture of two or more kinds may also be used. In the case of using a mixture of two or more kinds of the carrier liquid, for example, a mixture of a paraffin solvent and a vegetable oil, or a mixture of a silicone solvent and a vegetable oil may be used.

The volume resistivity of the carrier liquid may be, for example, in the range of $1.0\times10^{10}$ Ω·cm to $1.0\times10^{14}$ Ω·cm, and may also be in the range of $1.0\times10^{10}$ Ω·cm to $1.0\times10^{13}$ Ω·cm.

The carrier liquid may also contain various subsidiary materials such as, for example, a dispersant, an emulsifier, a surfactant, a stabilizer, a wetting agent, a thickening agent, a foaming agent, a defoamant, a coagulating agent, a gelling agent, a precipitation preventing agent, a charge-controlling agent, an antistatic agent, an aging preventing agent, a softening agent, a plasticizing agent, a filler, an odorant, an adhesion preventing agent, and a release agent.

Method for Preparing Liquid Developer

The liquid developer according to the exemplary embodiment is obtained by mixing the toner particles and the carrier liquid described above by using a dispersing machine such as, for example, a ball mill, a sand mill, an attritor, or a bead mill, pulverizing the mixture, and dispersing the toner particles in the carrier liquid. Meanwhile, the dispersion of the toner particles in the carrier liquid is not limited to the dispersing machine, and dispersion may be carried out by rotating a special stirring blade at a high speed, such as a mixer, may be carried out with the shear stress of a rotor-stator which is known as a homogenizer, or may be carried out by using ultrasonic waves.

The concentration of the toner particles in the carrier liquid is preferably adjusted to the range of 0.5% by weight to 40% by weight, and more preferably in the range of 1% by weight to 30% by weight, from the viewpoint of suitably controlling the viscosity of the developer and facilitating the developer liquid circulation in the developing machine.

Thereafter, the dispersion liquid thus obtained may be filtered by using, for example, a filter such as a membrane filter having a pore size of about 100 to remove contaminants and coarse particles.

Developer Cartridge, Process Cartridge, Image Forming Apparatus, and Image Forming Method The image forming apparatus according to the exemplary embodiment includes, for example, an image holding member (hereinafter, may be referred to as "photoreceptor"); a charging unit that charges a surface of the image holding member; a latent image forming unit that forms a latent image (electrostatic latent image) on the surface of the image holding member; a developing unit that develops the latent image formed on the surface of the image holding member, with the liquid developer according to the exemplary embodiment held at a surface of a developer holding member to form a toner image; a transfer unit that transfers the toner image formed on the surface of the image holding member on a recording medium; and a fixing unit that fixes the toner image transferred onto the recording medium to the recording medium to form a fixed image.

In the image forming apparatus described above, for example, the portion including the developing unit may have a cartridge structure (process cartridge) that is detachable from the main body of the image forming apparatus. This process cartridge may be any cartridge accommodating the liquid developer according to the exemplary embodiment described above, and there are no particular limitations. The process cartridge includes, for example, a developing unit which accommodates the liquid developer according to the exemplary embodiment described above, and develops a latent image formed on an image holding member with a liquid developer to form a toner image, and is detachable from the image forming apparatus.

Furthermore, the developer cartridge according to the exemplary embodiment may be any cartridge accommodating the liquid developer according to the exemplary embodiment described above, and there are no particular limitations. The developer cartridge includes, for example, a developing unit which accommodates the liquid developer according to the exemplary embodiment and develops a latent image formed on the image holding member with the liquid developer to form a toner image, and is detachable from the image forming apparatus.

Hereinafter, the image forming apparatus according to the exemplary embodiment of the present invention using a liquid developer will be described with reference to the drawing.

FIG. 1 is a schematic configuration diagram illustrating an example of the image forming apparatus according to the exemplary embodiment of the present invention. The image forming apparatus 100 includes a photoreceptor (image holding member) 10, a charging apparatus (charging unit) 20, an exposure apparatus (latent image forming unit) 12, a developing apparatus (developing unit) 14, an intermediate transfer member (transfer unit) 16, a cleaner (cleaning unit) 18, and a transfer fixing roller (transfer unit, fixing unit) 28. The photoreceptor 10 has a cylindrical shape, and the charging apparatus 20, exposure apparatus 12, developing apparatus 14, intermediate transfer member 16, and cleaner 18 are sequentially installed around the outer periphery of the photoreceptor 10.

Hereinafter, the operation of this image forming apparatus 100 will be explained.

The charging apparatus 20 charges the surface of the photoreceptor 10 to a predetermined potential (charging step), and the exposure apparatus 12 exposes the charged surface to, for example, a laser light or the like based on the image signals, and thereby forms a latent image (electrostatic latent image) (latent image forming step).

The developing apparatus 14 is constituted to include a developing roller 14*a* and a developer accommodating container 14*b*. The developing roller 14*a* is installed such that the developing roller 14*a* is partially immersed in the liquid developer 24 that is accommodated in the developer accommodating container 14*b*. The liquid developer 24 contains an insulating carrier liquid, toner particles containing a binder resin, and a charge-controlling agent.

In the liquid developer 24, the toner particles are dispersed, but for example, when the liquid developer 24 is further continuously stirred by a stirring member that is installed inside the developer accommodating container 14*b*, the positional fluctuation of the concentration of the toner particles in the liquid developer 24 is reduced. Thereby, a liquid developer 24 in which the concentration fluctuation of the toner particles has been decreased is supplied to the developing roller 14*a* that rotates in the direction indicated by the arrow A in the diagram.

The liquid developer 24 supplied to the developer roller 14*a* is conveyed to the photoreceptor 10, in a state in which the supply amount of the liquid developer is limited to a certain value by a regulating member, and is supplied to the electrostatic latent image at a position where the developing roller 14*a* and the photoreceptor 10 are brought closer (or brought to contact). Thereby, the electrostatic latent image is developed, and a toner image 26 is formed (developing step).

The developed toner image 26 is conveyed to the photoreceptor 10 that rotates in the direction indicated by the arrow B in the diagram, and is transferred onto paper (recording medium) 30. However, in the exemplary embodiment of the present invention, before the toner image is transferred onto the paper 30, in order to increase the efficiency of transfer to a recording medium, including the peeling efficiency of the toner image from the photoreceptor 10, and to thereby carry out transfer and fixing to the recording medium simultaneously, the toner image is first transferred onto an intermediate transfer member 16 (intermediate transfer step). At this time, a difference in the circumferential velocity may be provided between the photoreceptor 10 and the intermediate transfer member 16.

Subsequently, the toner image conveyed by the intermediate transfer member 16 in the direction indicated by the arrow C is simultaneously transferred and fixed to the paper 30 at the contact position with the transfer fixing roller 28 (transfer step and fixing step). The transfer fixing roller 28 has the paper 30 interposed between the roller and the intermediate transfer member 16, and closely attaches the toner image on the intermediate transfer member 16 to the paper 30. Thereby, the toner image is transferred onto the paper 30, and the toner image is fixed to the paper to form a fixed image 29. Fixing of the toner image is preferably carried out under pressure and under heating, by providing a heat generating member at the transfer fixing roller 28. The fixing temperature is usually in the range of 120° C. to 200° C.

When the intermediate transfer member 16 has a roller shape as illustrated in FIG. 1, since the intermediate transfer member constitutes a pair of rollers with the transfer fixing roller 28, in this constitution, the intermediate transfer member 16 and the transfer fixing roller 28 are equivalent to a fixing roller and a pressing roller, respectively, in the fixing apparatus, and exhibit a fixing function. That is, when the paper 30 passes through the nip formed between the intermediate transfer member 16 and the transfer fixing roller 28, the toner image is transferred, and at the same time, the intermediate transfer member 16 is heated and pressed by the transfer fixing roller 28. Thereby, the binder resin in the toner particles that constitute the toner image is softened, and at the same time, the toner image infiltrates into the fibers of the paper 30. Thus, a fixing image 29 is formed on the paper 30.

According to the exemplary embodiment, transfer and fixing to the paper 30 are carried out simultaneously, but fixing may also be carried out after performing transfer by separating the transfer step and the fixing step. In this case, the transfer roller that transfers the toner image from the photoreceptor 10 has a function equivalent to that of the intermediate transfer member 16.

On the other hand, in the photoreceptor 10 from which the toner image 26 has been transferred to the intermediate transfer member 16, toner particles that remain without being transferred are conveyed to the contact position with the cleaner 18 and collected by the cleaner 18. Meanwhile, when the transfer efficiency is close to 100% and there is no problem with residual toner, the cleaner 18 may not be provided.

The image forming apparatus 100 may further include an erasing device (not shown in the diagram) which erases electrical charge from the surface of the photoreceptor 10 after a transfer until the next charging.

The charging apparatus 20, exposure apparatus 12, developing apparatus 14, intermediate transfer member 16, transfer fixing roller 28, cleaner 18 and the like that are included in the image forming apparatus 100 may be operated such that, for example, all the apparatuses are operated synchronously to the speed of rotation of the photoreceptor 10.

The image forming method according to the exemplary embodiment includes: forming a latent image on a surface of an image holding member; developing the latent image formed on the surface of the image holding member with the liquid developer according to the exemplary embodiment that is held at a surface of a developer holding member to form a toner image; transferring the toner image formed on the surface of the image holding member to a recording medium; and fixing the toner image transferred on the recording medium to the recording medium to form a fixed image.

EXAMPLES

Hereinafter, the present invention will be more specifically described with reference to Examples and Comparative Examples, but the present invention is not intended to be limited to the following Examples.

Example 1

Preparation of Liquid Developer 100 parts by weight of C.I. Pigment Yellow 74 (manufactured by Sanyo Color Works, Ltd.) as a yellow pigment, 100 parts by weight of C.T. Pigment Blue 15:3 (manufactured by Dainichiseika Color and Chemicals Manufacturing Co., Ltd.) as a cyan pigment, 100 parts by weight of C.I. Pigment Red 122 (manufactured by DIC Corporation) as a magenta pigment, and 66.7 parts by weight of carbon black (manufactured by Cabot Corp., R330) as a black pigment are respectively used, and 100 parts by weight of a polyester resin (manufactured by DIC Corporation, acid value: 13 mg KOH/g, weight average molecular weight: Mw 10,000) is used as a resin. These substances are preliminarily mixed with 70 parts by weight of water, and a wet cake into which the pigments and the resin are mixed is obtained. Furthermore, a flushing treatment is carried out by using 20 parts by weight of PAA-25 (manufactured by Nitto Boseki Co., Ltd., weight average molecular weight: Mw 25,000) as a polyallylamine compound for the yellow, magenta and cyan pigments, and by using 13.3 parts by weight of PAA-25 (manufactured by Nitto Boseki Co., Ltd., weight average molecular weight: Mw 25,000) as a polyallylamine compound for the black pigment, while mixing the resins and the wet cake by a kneader. Thus, a surface-treated pigment master batch 1 is prepared.

Subsequently, a mixture having the following composition is kneaded with a pressure kneader.

70 parts by weight of a polyester resin (manufactured by DIC Corporation, acid value: 13 mg KOH/g, weight average molecular weight: Mw 10,000)

Surface-treated pigment master batch 1:30 parts by weight (yellow, magenta, and cyan), 42 parts by weight (black)

The kneaded product thus obtained is crude pulverized with a sample mill, and then a mixture containing 20 parts by weight of the crude powder thus obtained and 80 parts by weight of an aliphatic hydrocarbon (manufactured by Matsumura Sekiyu Co., Ltd., MORESCO WHITE P40) as a carrier liquid is pulverized for 80 hours with a ball mill. Thus, a dispersion liquid containing toner particles having a volume average particle size of 1.6 μm is obtained.

A dispersant is added to this dispersion liquid to prepare a liquid developer, and the liquid developer is subjected to the following evaluation of characteristics.

Measurement of Conductivity

The conductivity of the liquid developer is measured by using a conductivity meter (manufactured by Horiba, Ltd., LAQUA DS-70). The results are described in Table 1.

Evaluation of Developability

An image forming apparatus such as illustrated in FIG. 1 is used, and a liquid developer layer is formed with each of the liquid developers obtained in the Examples and Comparative Examples, on the developing roller of the image forming apparatus. Subsequently, the surface potential of the developing roller is adjusted to 300 V, and the photoreceptor is charged approximately uniformly at a surface potential of 500V. The photoreceptor is exposed, and the charge at the surface of the photoreceptor is attenuated to decrease the surface potential to 50 V. After the liquid developer layer passes through between the photoreceptor and the developing roller, the toner particles on the developing roller and the toner particles on the photoreceptor are collected by using tapes. The respective tapes used for the collection are attached on a recording paper, and the concentration of the toner particles in each unit is measured. After the measurement, the concentration of the toner particles collected on the photoreceptor is divided by the sum of the concentration of the toner particles collected on the photoreceptor and the concentration of the toner particles collected on the developing roller, and the quotient is multiplied by 100 to determine the developing efficiency. An evaluation of developability is carried out on the basis of the following four-grade criteria. The results are described in Table 1.

A: The developing efficiency is 96% or greater, and the developer has especially excellent developing efficiency.

B: The developing efficiency is greater than or equal to 90% and less than 96%, and the developer has excellent developing efficiency.

C: The developing efficiency is greater than or equal to 80% and less than 90%, and there is no problem in practical use.

D: The developing efficiency is less than 80%, and the developer has poor developing efficiency.

Evaluation of Transferability

An image forming apparatus such as that illustrated in FIG. 1 is used, and a liquid developer layer is formed from each of the liquid developers obtained in the Examples and Comparative Examples, on the photoreceptor of the image forming apparatus. Subsequently, after the liquid developer layer passes through between the photoreceptor and the intermediate transfer member, the toner particles on the photoreceptor and the toner particles on the intermediate transfer member are collected by using tapes. The respective tapes used for the collection are attached on a recording paper, and the concentration of the toner particles in each unit is measured. After the measurement, the concentration of the toner particles collected on the intermediate transfer member is divided by the sum of the concentration of the toner particles collected on the photoreceptor and the concentration of the toner particles collected on the intermediate transfer member, and the quotient is multiplied by 100 to determine the transfer efficiency. An evaluation of transferability is carried out on the basis of the following four-grade criteria. The results are described in Table 1.

A: The transfer efficiency is 96% or greater, and the developer has especially excellent transfer efficiency.

B: The transfer efficiency is greater than or equal to 90% and less than 96%, and the developer has excellent transfer efficiency.

C: The transfer efficiency is greater than or equal to 80% and less than 90%, and there is no problem in practical use.

D: The transfer efficiency is less than 80%, and the developer has poor transfer efficiency.

Evaluation of Positive Chargeability

For each of the liquid developers obtained in the Examples and Comparative Examples, the potential difference is measured by using a "microscope type laser zeta-potential meter", ZC-3000, manufactured by Microtec Nition Co., Ltd., and the liquid developers are evaluated on the basis of the following five-grade criteria. The measurement is carried out by diluting the liquid developer with a diluent solvent, placing the dilution in a 10-mm transparent cell, applying a voltage of 300 V at a gap between electrodes of 9 mm, and simultaneously observing the speed of movement of the particles in the cell with a microscope. Thus, the speed of movement is calculated, and the zeta potential is determined from the speed of movement value. The results are described in Table 1.

A: The potential difference is greater than or equal to +100 mV (very good)

B: The potential difference is greater than or equal to +85 mV and less than +100 mV (good)

C: The potential difference is greater than or equal to +70 mV and less than +85 mV (mediocre)

D: The potential difference is greater than or equal to +50 mV and less than +70 mV (slightly poor)

E: The potential difference is less than +50 mV (very poor)

Meanwhile, the charge-controlling agent may be collected from the liquid developer by the method described below. A liquid developer is sedimented by centrifugation (1,000 rpm×5 min), the supernatant is removed by decantation, and the toner is removed. The removed toner is washed with a solvent mixture of hexane/ethyl acetate=1/1 (the solvent mixture may be appropriately modified depending on the toner resin). The liquid used for washing is dried under reduced pressure at 150° C., and thereby the charge-controlling agent is collected.

Example 2

A liquid developer sample is prepared in the same manner as in Example 1, except that the amount of the polyallylamine compound is changed to 5 parts by weight for the yellow, magenta and cyan pigments, and to 3.3 parts by weight for the black pigment, and the liquid developer sample is evaluated. The results are described in Table 1.

Example 3

A liquid developer sample is prepared in the same manner as in Example 1, except that the amount of the polyallylamine compound is changed to 30 parts by weight for the yellow, magenta and cyan pigments, and to 20 parts by weight for the black pigment, and the liquid developer sample is evaluated. The results are described in Table 1.

Example 4

A liquid developer sample is prepared in the same manner as in Example 1, except that the polyallylamine compound is changed to 13.3 parts by weight of PAA-15 (manufactured by Nitto Boseki Co., Ltd., weight average molecular weight: Mw 15,000) for the yellow, magenta and cyan pigments, and to 8.9 parts by weight of PAA-15 for the black pigment, and the liquid developer sample is evaluated. The results are described in Table 1.

Example 5

A liquid developer sample is prepared in the same manner as in Example 1, except that 100 parts by weight of a styrene-acrylic resin (manufactured by Fujikura. Kasei Co., Ltd., acid value: 10 mg KOH/g, weight average molecular weight; Mw 10,000) as the resin, and the liquid developer sample is evaluated. The results are described in Table 1.

Example 6

A liquid developer sample is prepared in the same manner as in Example 1, except that the surface-treated pigment master batch is prepared by performing melt kneading with two rollers, without performing a flushing treatment, and the liquid developer sample is evaluated. The results are described in Table 1.

Example 7

A liquid developer sample is prepared in the same manner as in Example 1, except that the polyallylamine compound is changed to 13.3 parts by weight of PAA-01 (manufactured by Nitto Boseki Co., Ltd., weight average molecular weight; Mw 1,600) for the yellow, magenta and cyan pigments, and to 8.9 parts by weight of PAA-01 for the black pigment, and the liquid developer sample is evaluated. The results are described in Table 1.

Example 8

A liquid developer sample is prepared in the same manner as in Example 1, except that the polyallylamine compound is changed to 20 parts by weight of a compound (weight average molecular weight: Mw 30,000) synthesized by making reference to JP-A-60-104107, JP-A-60-192715, JP-A-61-60703 and the like, and the liquid developer sample is evaluated. The results are described in Table 1.

Example 9

A liquid developer sample is prepared in the same manner as in Example 1, except that the polyallylamine compound is changed to 20 parts by weight of a compound (weight average molecular weight: Mw 10,000) synthesized by making reference to JP-A-60-104107, JP-A-60-192715, JP-A-61-60703 and the like, and the liquid developer sample is evaluated. The results are described in Table 1.

Example 10

A liquid developer sample is prepared in the same manner as in Example 1, except that the polyallylamine compound is changed to 20 parts by weight of a compound (weight average molecular weight: Mw 35,000) synthesized by making reference to JP-A-60-104107, JP-A-60-192715, JP-A-61-60703 and the like, and the liquid developer sample is evaluated. The results are described in Table 1.

Example 11

A liquid developer sample is prepared in the same manner as in Example 1, except that the amount of the polyallylamine compound is changed to 2 parts by weight for the yellow, magenta and cyan pigments, and to 1.3 parts by weight for the black pigment, and the liquid developer sample is evaluated. The results are described in Table 1.

Example 12

A liquid developer sample is prepared in the same manner as in Example 1, except that the amount of the polyallylamine compound is changed to 40 parts by weight for the yellow, magenta and cyan pigments, and to 26.7 parts by weight for the black pigment, and the liquid developer sample is evaluated. The results are described in Table 1.

Example 13

A liquid developer sample is prepared in the same manner as in Example 1, except that the resin is changed to 100 parts by weight of a polyester resin (manufactured by DIC Corporation, acid value: 1 mg KOH/g, weight average molecular weight: Mw 10,000) for the yellow, magenta and cyan pigments, and to 66.7 parts by weight of the polyester resin for the black pigment, and the liquid developer sample is evaluated. The results are described in Table 1.

Example 14

A liquid developer sample is prepared in the same manner as in Example 1, except that the resin is changed to 100 parts by weight of a polyester resin (manufactured by DIC Corporation, acid value: 30 mg KOH/g, weight average molecular weight: Mw 10,000) for the yellow, magenta and cyan pigments, and to 66.7 parts by weight of the polyester resin for the black pigment, and the liquid developer sample is evaluated. The results are described in Table 1.

Example 15

A liquid developer sample is prepared in the same manner as in Example 1, except that the resin is changed to 100 parts by weight of a polyester resin (manufactured by DIC Corporation, acid value: 0.5 mg KOH/g, weight average molecular weight: Mw 10,000) for the yellow, magenta and cyan pigments, and to 66.7 parts by weight of the polyester resin for the black pigment, and the liquid developer sample is evaluated. The results are described in Table 1.

Example 16

A liquid developer sample is prepared in the same manner as in Example 1, except that the resin is changed to 100 parts by weight of a polyester resin (manufactured by DIC Corporation, acid value: 40 mg KOH/g, weight average molecular weight: Mw 10,000) for the yellow, magenta and cyan pigments, and to 66.7 parts by weight of the polyester resin for the black pigment, and the liquid developer sample is evaluated. The results are described in Table 1.

Comparative Example 1

A liquid developer sample is prepared in the same manner as in Example 1, except that no polyallylamine compound is used, and the liquid developer sample is evaluated. The results are described in Table 1.

Comparative Example 2

A liquid developer sample is prepared in the same manner as in Example 1, except that 2 parts by weight of a quaternary ammonium salt (manufactured by Orient Chemical Industries Co., Ltd., BONTRON P-51) for the yellow, magenta and cyan pigments, and 1.3 parts by weight of the quaternary ammonium salt for the black pigment were used instead of a polyallylamine compound, and the liquid developer sample is evaluated. The results are described in Table 1.

TABLE 1

| | Resin | Resin acid value (mg KOH/g) | Surface treating agent | weight average molecular weight Mw | Amount of addition | Flushing treatment | Conductivity (S/m) | Developability | Transferability | Positive chargeability |
|---|---|---|---|---|---|---|---|---|---|---|
| Example 1 | Polyester | 13 | PAA-25 | 25000 | 2 | Present | 3.4E−13 | A | A | A |
| Example 2 | Polyester | 13 | PAA-25 | 25000 | 0.5 | Present | 2.9E−13 | A | B | B |
| Example 3 | Polyester | 13 | PAA-25 | 25000 | 3 | Present | 9.2E−12 | B | B | A |
| Example 4 | Polyester | 13 | PAA-15 | 15000 | 2 | Present | 8.7E−12 | B | B | B |
| Example 5 | Styrene-acrylic | 10 | PAA-25 | 25000 | 2 | Present | 7.6E−12 | A | B | B |
| Example 6 | Polyester | 13 | PAA-25 | 25000 | 2 | Absent | 2.5E−10 | C | C | C |
| Example 7 | Polyester | 13 | PAA-01 | 1600 | 2 | Present | 7.3E−12 | C | C | C |
| Example 8 | Polyester | 13 | Synthetic product | 30000 | 2 | Present | 7.7E−12 | B | B | B |
| Example 9 | Polyester | 13 | Synthetic product | 10000 | 2 | Present | 6.9E−12 | C | B | C |
| Example 10 | Polyester | 13 | Synthetic product | 35000 | 2 | Present | 8.4E−12 | B | C | C |
| Example 11 | Polyester | 13 | PAA-25 | 25000 | 0.2 | Present | 1.8E−13 | C | C | C |
| Example 12 | Polyester | 13 | PAA-25 | 25000 | 4 | Present | 7.5E−12 | B | C | B |
| Example 13 | Polyester | 1 | PAA-25 | 25000 | 2 | Present | 8.6E−11 | C | C | C |
| Example 14 | Polyester | 30 | PAA-25 | 25000 | 2 | Present | 7.7E−12 | C | C | C |
| Example 15 | Polyester | 0.5 | PAA-25 | 25000 | 2 | Present | 7.5E−11 | C | C | D |
| Example 16 | Polyester | 40 | PAA-25 | 25000 | 2 | Present | 9.4E−12 | C | C | D |
| Comp. Ex. 1 | Polyester | 13 | None | — | — | Present | 6.7E−13 | D | D | E |
| Comp. Ex. 2 | Polyester | 13 | Quaternary ammonium | — | 2 | Present | 3.8E−10 | D | D | E |

As such, the Examples in which a pigment that is surface-treated with a polyallylamine compound as a colorant is used exhibited excellent positive chargeability as compared with the Comparative Examples. Furthermore, in the Examples, there were almost no differences in the chargeability between the colors of yellow, magenta, cyan and black, as compared with the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:

a carrier liquid; and toner particles containing a binder resin and a pigment surface-treated with a polyallylamine compound as a colorant.

2. The liquid developer according to claim 1, wherein an acid value of the binder resin is in the range of 1 mg KOH/g to 30 mg KOH/g.

3. The liquid developer according to claim 1, wherein the surface treatment is a flushing treatment of adding a resin and the polyallylamine compound to a dispersion liquid of the pigment, and performing mixing and stirring.

4. The liquid developer according to claim 2, wherein the surface treatment is a flushing treatment of adding a resin and the polyallylamine compound to a dispersion liquid of the pigment, and performing mixing and stirring.

5. The liquid developer according to claim 1, wherein a weight average molecular weight of the polyallylamine compound is in the range of 15,000 to 30,000.

6. The liquid developer according to claim 2, wherein a weight average molecular weight of the polyallylamine compound is in the range of 15,000 to 30,000.

7. The liquid developer according to claim 3, wherein a weight average molecular weight of the polyallylamine compound is in the range of 15,000 to 30,000.

8. A developer cartridge containing the liquid developer according to claim 1.

9. A process cartridge containing the liquid developer according to claim 1.

10. An image forming method comprising:

forming a latent image on a surface of an image holding member;

developing the latent image formed on the surface of the image holding member with the liquid developer according to claim 1 that is held at a surface of a developer holding member to form a toner image;

transferring the toner image formed on the surface of the image holding member to a recording medium; and fixing the toner image transferred on the recording medium to the recording medium to form a fixed image.

* * * * *